US006851397B2

(12) United States Patent
Akimoto et al.

(10) Patent No.: US 6,851,397 B2
(45) Date of Patent: Feb. 8, 2005

(54) POWER GENERATOR UNIT

(75) Inventors: Satoru Akimoto, Iwata (JP); Misato Kobayashi, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/397,107

(22) Filed: Mar. 25, 2003

(65) Prior Publication Data

US 2003/0183181 A1 Oct. 2, 2003

(30) Foreign Application Priority Data

Mar. 27, 2002 (JP) ..... 2002-088245

(51) Int. Cl.[7] ..... F02B 63/00
(52) U.S. Cl. ..... 123/2; 123/198 E; 290/1 A
(58) Field of Search ..... 123/198 E, 0.2; 290/1 A

(56) References Cited

U.S. PATENT DOCUMENTS 4,836,123 A 6/1989 Grinde et al.
4,856,470 A * 8/1989 Ishii et al. ..... 123/195 C
5,018,492 A * 5/1991 Wolf et al. ..... 123/198 E
5,531,351 A * 7/1996 Logsdon ..... 220/571.1

FOREIGN PATENT DOCUMENTS

| | | |
|---|---|---|
| JP | 60-162435 | 8/1985 |
| JP | 02-087998 | 3/1990 |
| JP | 04-331441 | 11/1992 |

* cited by examiner

*Primary Examiner*—Thomas Denion
*Assistant Examiner*—Zelalem Eshete
(74) *Attorney, Agent, or Firm*—Knobbe, Martens, Olson & Bear LLP

(57) ABSTRACT

A portable power generator unit incorporates an engine and a generator driven by the engine. The generator incorporates a multi piece sound insulation cover that allows for efficient cooling of the various internal components. Various access openings located in the multi piece sound insulation cover allow for easy servicing of the power generator. An access-opening lid acts as a tool to help service the internal combustion engine when draining and adding lubricant.

27 Claims, 6 Drawing Sheets

POWER GENERATOR UNIT

PRIORITY INFORMATION

This application is based on and claims priority under 35 U.S.C. §119 to Japanese Patent Application No. 2002-088245, filed on Mar. 27, 2002, the entire contents of which are hereby expressly incorporated by reference herein.

BACKGROUND OF THE INVENTION

1. Field of the Invention

The present invention generally relates to a portable power supply. More particularly, the present invention relates to a portable power supply that incorporates a generator driven by an engine.

2. Description of the Related Art

Portable power supplies such as power generators that incorporate a generator driven by an internal combustion engine are popular for various uses. Improved power generator designs that incorporate reduced maintenance features provide less interrupted operation, thereby allowing for hours of trouble free operation. Certain servicing practices, such as air and fuel filter replacements and fluid changes, however, remain necessary to assure long operational life. Many of these service requirements are cumbersome and various inconveniences can occur, for example, fluid can spill. Since many portable power supplies are enclosed to promote quiet operation, excess fluid that has spilled and that remains on or in the vicinity of the internal combustion engine can promote a messy, dirty engine environment.

SUMMARY OF THE INVENTION

An aspect of the present invention involves a power generator unit comprising a generator driven by an internal combustion engine. The engine has at least one fluid hole (e.g., a lubricant filler hole) to add fluid to or drain fluid from the engine and is at least partially surrounded by a cover. The cover includes an opening. A lid is removably attached to the cover to close the opening and includes a channel on one side of the lid. The lid can be used to assist in filling and draining fluid through the fluid hole of the engine. In a preferred embodiment, the lid is removably attached to the engine at a location near the fluid hole.

Another aspect of the present invention involves a method of servicing a lubrication system of an internal combustion engine. The method includes the steps of removing a detachable lid from a position on an engine cover in which the lid is integral with the structure of the cover and positioning the detachable lid on the engine at a position near a lubricant filler and/or drain hole of the engine. The lid is used to guide lubricant relative to the filler or drain hole. After use, the lid is repositioned and is reattached on the engine cover.

In accordance with an additional aspect of the present invention, a power generator unit is provided that comprises an internal combustion engine and a generator driven by the internal combustion engine. The engine has a fluid hole and a cover surrounds at least a portion of the internal combustion engine. The power generator unit also includes means for guiding lubricant relative to the fluid hole. The means is movable between a storage position, in which the means is integral with the cover, and a position in which the means is removably attached to the engine at a position relative to the fluid hole to assist in filling and draining fluid through the fluid hole of the engine.

A further aspect of the present invention involves a power generating device that produces power (e.g., electrical, mechanical, or optical power or a combination thereof). The power generating device comprises a prime mover and a cover that at least partially surrounds the prime mover. The prime mover includes a body defining a fluid hole. The cover has a removable section that cooperates with the prime mover body to releasably attach to the body at a location near the fluid hole. In a preferred embodiment, the removable section can function either as a catch for fluid (e.g., lubricant, fuel, water) dripping as fluid is added or removed from the fluid hole or as a guide for delivering fluid to or draining fluid from the fluid hole.

These and other aspects, features and advantages of the present invention will become readily apparent to those skilled in the art from the following detailed description of preferred embodiment, which refers to the attached figures. The invention is not limited, however, to the particular embodiment that is disclosed.

BRIEF DESCRIPTION OF THE DRAWINGS

The embodiment described herein will be readily understood by the following detailed description in conjunction with the accompanying drawings, wherein like reference numerals designate like structural elements among the figures.

FIG. 3 illustrates a lubricant filler section and a filler cap on the engine, and a lid that functions as a lubricant filler adopter and that is shown in a storage position on the bottom side of the power generator unit.

DETAILED DESCRIPTION OF THE PREFERRED EMBODIMENT OF THE INVENTION

Figure 1:
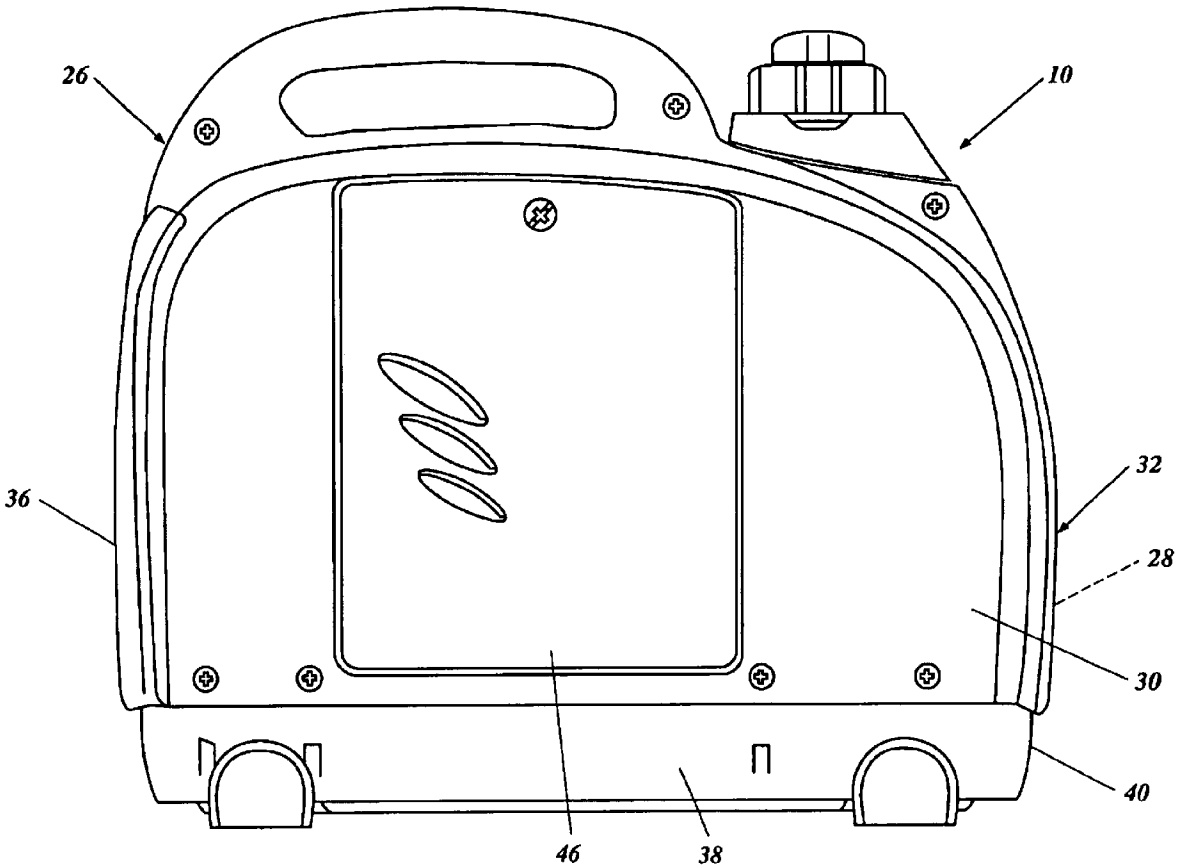
FIG. 1 is a side view of a power generator unit that is configured in accordance with certain aspects, features, aspects and advantages of the present invention.
Figure 2:
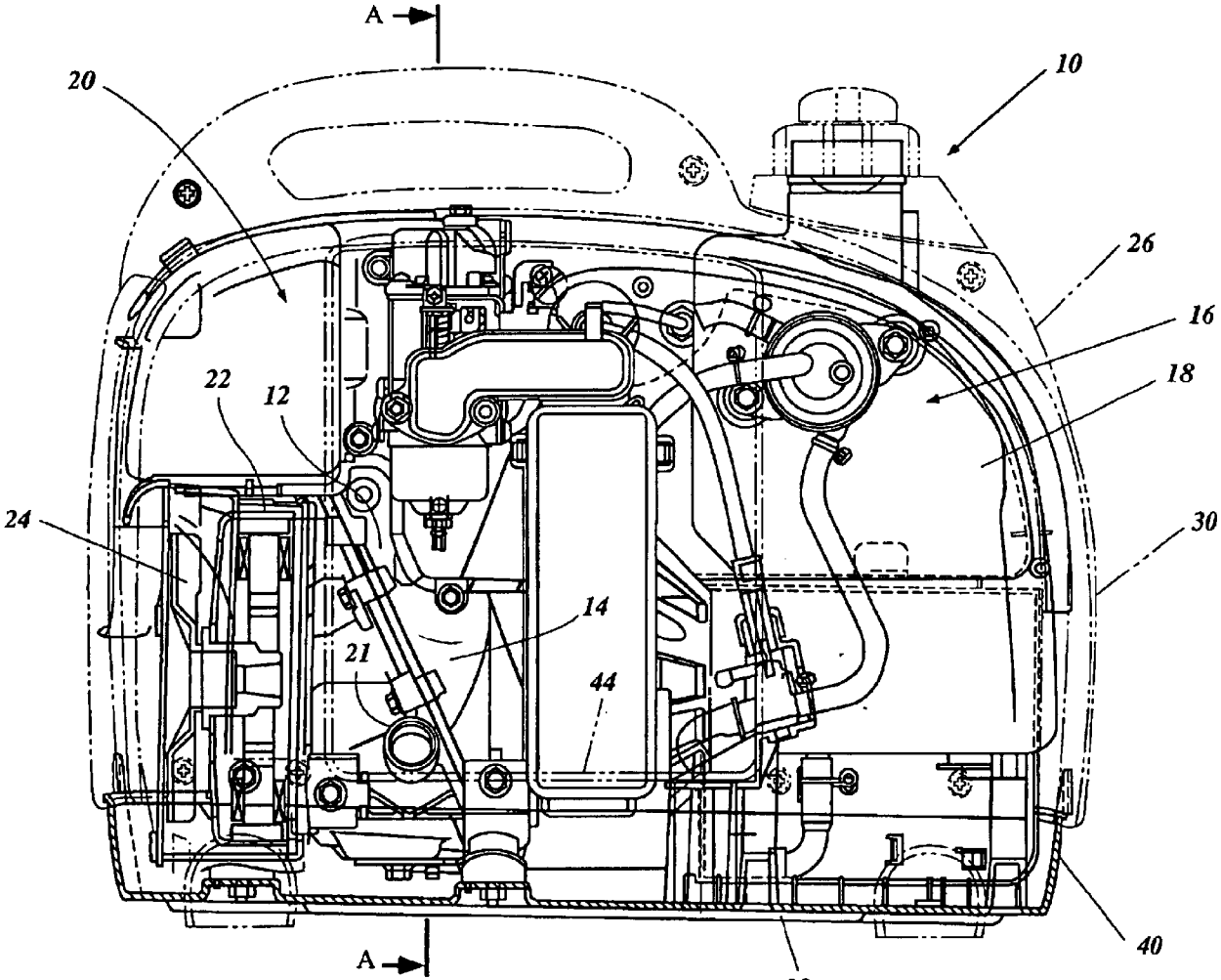
FIG. 2 is a sectioned view of the power generator unit of FIG. 1 illustrating various internal components thereof, including an engine.

With reference initially to FIGS. 1 and 2, an overall structure of an electrical power generator unit 10, with various features, aspects and advantages of the present invention, will be described. The present invention is particularly useful in connection with a portable electrical power generator unit and, accordingly, will be described in this context. Many aspects, features and advantages of the present invention, however, can be practices with other types of power generating devices in which a cover surrounds a prime mover. Such power generating devices can produce other forms of power, such as, for example, mechanical or optical power, in the alternative to or in addition to electrical power. For example, the present invention can be used in connection with pumps.

The illustrated power generator unit 10 comprises an internal combustion engine 12 as its prime mover. The engine operates on a four-cycle combustion principle. The engine 12 includes a crankcase 14 and a cylinder block incorporating a cylinder bore (not shown), classifying the engine 12 as a single cylinder engine. The illustrated engine, however, merely exemplifies one type of engine in connection with which various aspects and features of the present invention can be used. Engines having a different number of cylinders, having other cylinder arrangements, having other cylinder orientations (e.g., upright cylinder banks, V-type, and W-type), and operating on other combustion principles (e.g., crankcase compression two-stroke, diesel, and rotary) are all practicable. Other orientations of the engine are also possible (e.g., with a transversely or vertically oriented crankshaft).

A piston (not shown) reciprocates in the cylinder bore formed within the cylinder block. A cylinder head is affixed to the upper end of the cylinder block to close the upper end of the cylinder bore. The cylinder head, the cylinder bore and the piston together define a combustion chamber (not shown). The crankcase 14 is affixed to the lower end of the cylinder block to close the lower end of the cylinder bore and to define, in part, a crankshaft chamber. The crankshaft (not shown) is journaled by bearings that are supported by the cylinder block and the crankcase 14. The crankshaft is rotatably connected to the piston through a connecting rod (not shown).

The cylinder block, the cylinder head, and the crankcase 14 together generally define an engine body of the engine 12. The engine body preferably is made of an aluminum-based alloy; however, other materials can be used.

The engine 12 preferably includes a fuel supply system 16 including a fuel tank 18. The fuel supply system 16 supplies fuel from the fuel tank 18 to the engine 12. Other systems including, but not limited to, an ignition system (not shown), an induction system, and an exhaust system 20 are incorporated into the engine 12.

A lubrication system contains lubricant that can be delivered under pressure by an oil pump and through an oil filter to various positions within the engine 12 such as, but not limited to, bearings, the cylinder bore, etc. The lubricant can be stored within the engine 12 or in a separate lubricant tank. Properties of the lubricant can allow it to act as a cleanser collecting debris and contaminants that are common byproducts of the engine combustion process that are not filtered by the oil filter. Periodic service of the engine can include draining used lubricant and replenishing the engine 12 with new lubricant to promote a longer engine operating life.

One or more fluid holes 21 can be positioned on the engine 12 to allow a fluid(s) (e.g., lubricant) to be drained and/or replaced. In the illustrated embodiment, the fluid hole 21 includes a protruding boss extending from the engine 12 and an opening that leads into a portion of the lubrication system (e.g., into the crankcase) to assist in filling and draining lubricant. A sound insulation cover 26 can incorporate one or more access openings in the vicinity of the fluid hole or holes to allow easy engine service.

An AC generator 22, that includes generator cooling fan 24, is disposed next to the engine 12 and is driven by the engine 12. A shaft of the generator (not shown) is coupled with the output shaft of the engine 12 and rotates together with the engine crankshaft. The AC generator 22 generates an alternating current (AC) power.

A power-converting unit (not shown) is electrically coupled with the generator 22 to convert the AC power to a high quality AC power (that is, AC power substantially free from voltage and frequency variations and other distortions). The power-converting unit incorporates an electronic control module (not shown) to control an output of the power-converting unit. The power generator unit 10 also includes a DC/DC converter. The DC/DC converter is electrically coupled to the power-converting unit.

The electronic control module coordinates how to use the output of the generator 22 and the output of the DC/DC converter in addition to controlling the output of the power-converting unit. Preferably, the control module comprises at least a central processing unit (CPU) and a memory or storage.

As seen in FIGS. 1 and 2, the power generator unit 10 preferably includes the multiple piece sound insulation cover 26. The multiple piece sound insulation cover 26 comprises a front panel 28 and a rear panel 30 that together make up a two piece panel 32. The multiple piece sound insulation cover 26 also comprises a side access panel 36, and a bottom tray 38. The bottom tray incorporates a side wall portion 40 that extends vertically to meet with the front panel 28, the rear panel 30, and the side access panel 36. The two piece panel 32, the side access panel 36 and the bottom tray 38 can incorporate insulating fiber material or internal metal coverings to further improve the sound proofing of the insulating cover 26. All of the power generator internal components, such as but not limited to, the engine 12, the generator 22, and the fuel tank 18 are directly or indirectly secured to the bottom tray 38 and are completely covered by the multiple piece sound insulation cover 26. In this manner, these internal components of the illustrated generator unit 10 are housed in a compartment within the cover 26.

Various internal components can be accessed and serviced through a rear access opening 44 that is incorporated into the rear access panel 30. The engine is advantageously positioned so that the protruding cylindrical shaped fluid hole 21, which is incorporated onto the crankcase 14 and is used in filling and draining a lubricant from the engine 12, can be easily accessed through the access opening 44. An access panel 46 covers the rear access opening 44 when access is not necessary. The fluid hole 21 can be opened and closed through a detachable fluid hole plug 52. The fluid hole plug 52 can securely close the fluid hole 21 through various closing systems. These closing systems can include, but are not limited to, a threaded plug, a push/pull fitted plug, etc.

Figure 3:
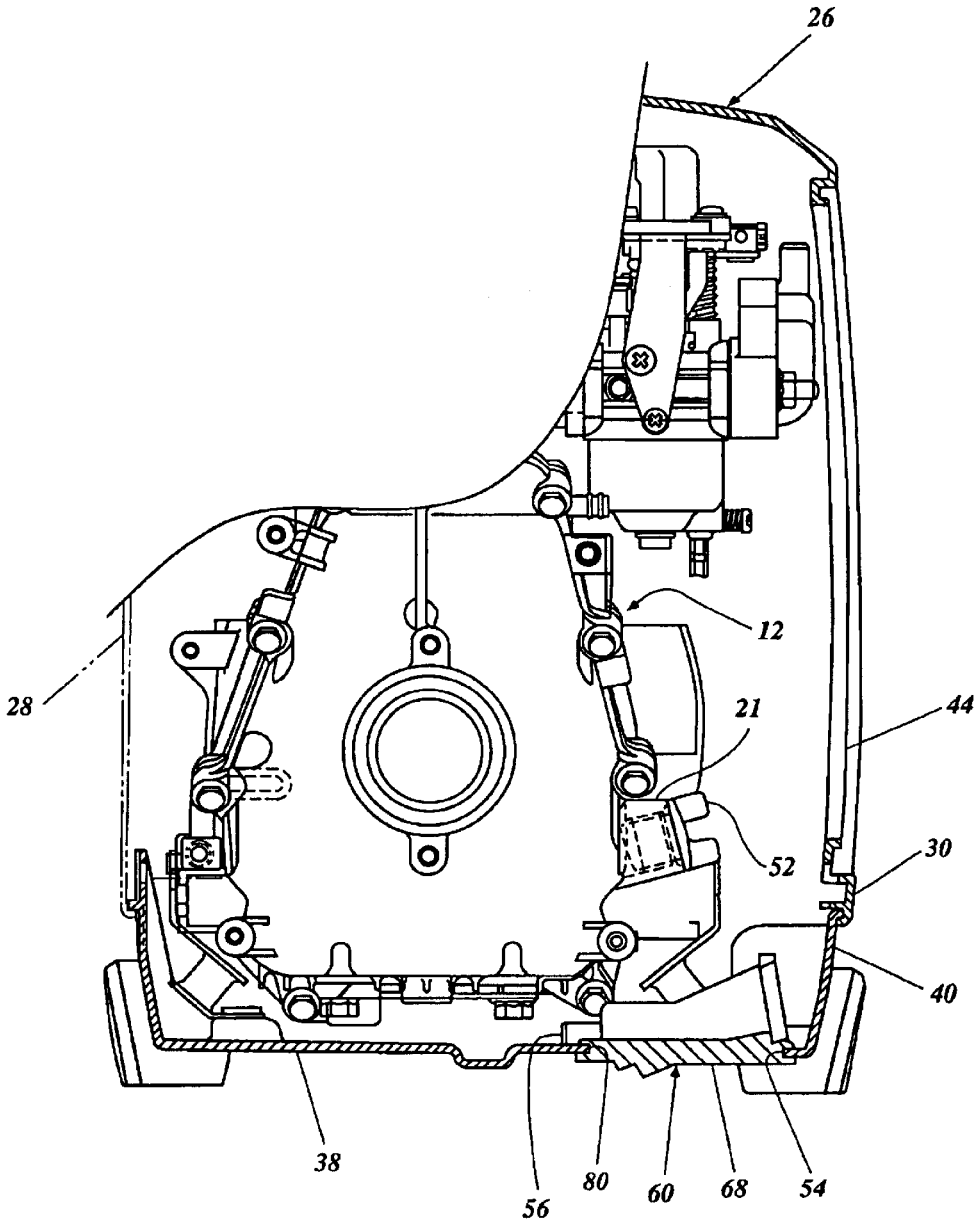
FIG. 3 is a sectioned view of the power generator unit taken along line A—A of FIG. 2.
Figure 4:
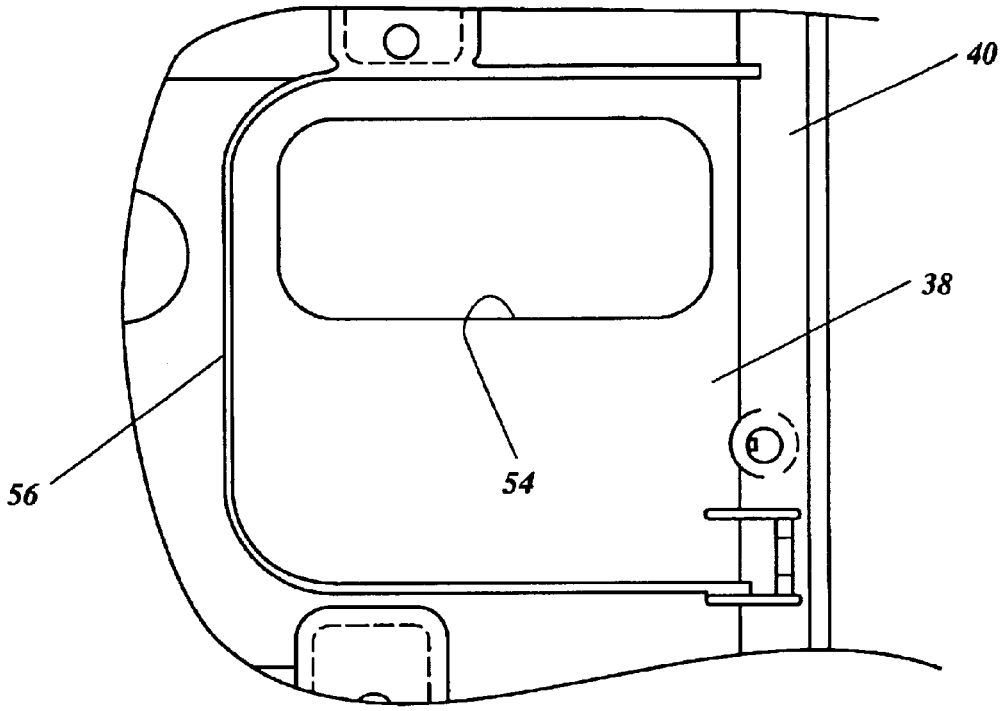
FIG. 4 is a partial bottom view of the power generator unit of FIG. 1 and illustrates an opening in a bottom panel of the power generator unit into which the lid shown in FIG. 3 can fit.

With reference to FIGS. 3 and 4, a bottom tray opening 54 is advantageously located directly below the fluid hole 21. The bottom tray opening 54 incorporates an upwardly protruding rib 56 that along with the bottom tray side wall 40 surrounds the opening 54. Residual fluid can accumulate around the fluid hole 21 during servicing or from spilling. This residual fluid can travel down the engine 12 and/or drip toward the bottom tray 40. The vertically protruding rib 56 along with the bottom tray side wall 40 inhibit the residual fluid from spreading into the remaining area of the bottom tray 38. In the illustrated embodiment, the protruding rib 56 along with the bottom tray side wall 40 assist in keeping the bottom tray clean by providing a fenced collection area into which the lubricant can fall and, if the bottom tray opening 54 is open, by allowing lubricant to pass through the opening 54.

Figure 5A:
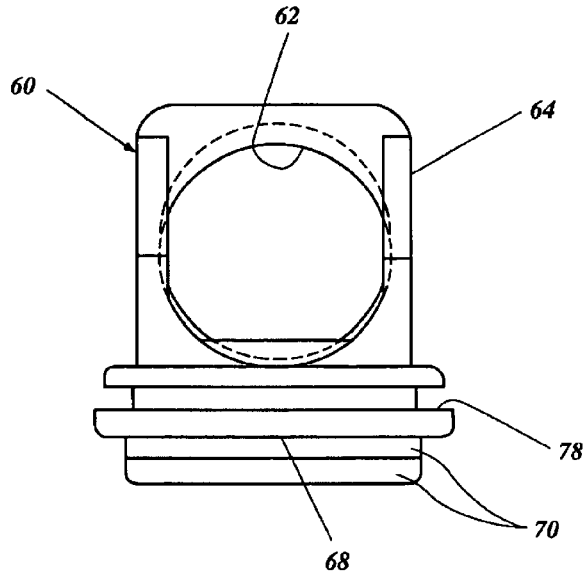
FIG. 5*a* illustrates an end view of the lid of FIG. 3, which is configured in accordance with a preferred embodiment of the present invention and which is shown apart from the rest of the power generator unit.
Figure 5B:
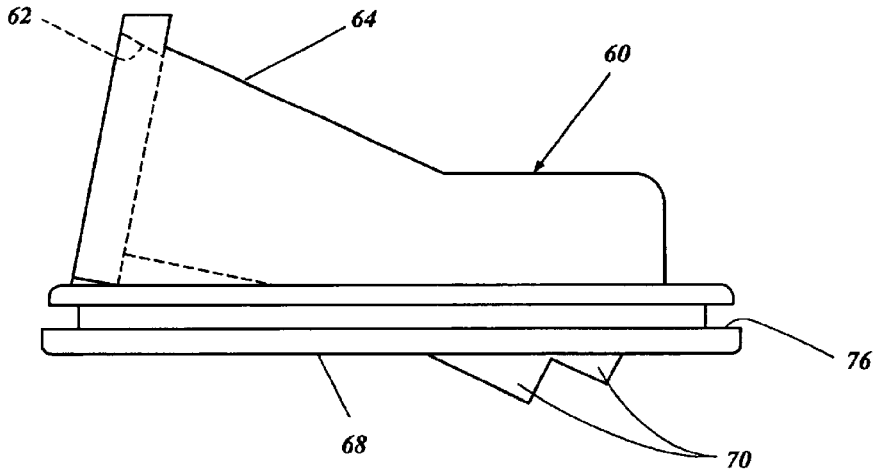
FIG. 5*b* illustrates a side view of the lid of FIG. 5*a*.

FIGS. 5*a* and 5*b* illustrate details of a fluid hole adapter 60 that also acts as a lid for the bottom tray opening 54. The fluid hole adapter 60 aids in the draining and filling of the engine 12 with lubricant. The fluid hole adapter 60 is made of a resilient material incorporating a hole 62 to advantageously fit around the protruding fluid hole 21. The resilient material of the fluid adapter 60 allows the fluid adapter hole 62 to be securely fitted to the fluid hole 21 forming a fluid tight seal.

The fluid hole adapter 60 has two side walls 64 that form a channel. When attached to the fluid hole 21 the two side walls 64 guide lubricant between an open end of the fluid hole adapter 60 and the fluid hole 21. An outer bottom surface 68 of the fluid hole adapter 60 incorporates a stepped surface 70. The stepped surface 70 advantageously positions the fluid hole adapter 60 against a lower edge 72 of the rear access opening 44 as seen in FIG. 6.

Figure 6:
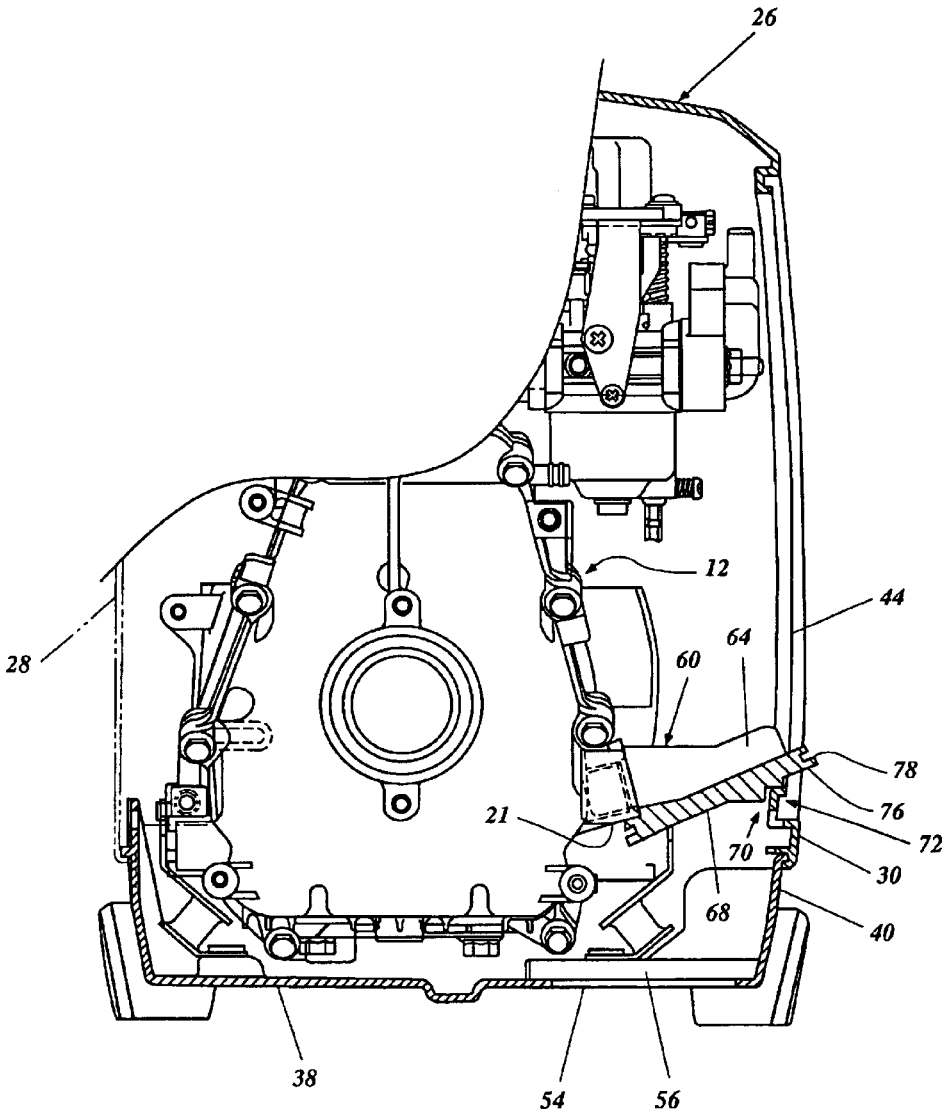
FIG. 6 is a partial sectional view of the power generator unit of FIG. 3 and illustrates the lid positioned on the engine relative to the lubricant filler section of the engine.

In the filling/draining position shown in FIG. 6, the fluid hole adapter 60 is secured by the positioning hole 62 fitted around the fluid hole 21 and the stepped surface 70 fitted on the lower edge 72 of the rear access opening 44.

During filling, the fluid hole adapter 60 is in a descending position from the lower edge 72 of the rear access opening 44 to the fluid hole 21. The descending position assures that residual fluid located around the fluid hole 21 and in the fluid hole adapter 60 always flows downward along the fluid hole adapter 60 and through the fluid hole 21. If lubricant should spill during filling, the bottom tray opening 54 is open allowing any spilled fluid to fall through the bottom tray opening 54 and, thereby, leaving the inside of the bottom tray 38 (and the inside of the power generator unit 10) cleaner.

During draining of the lubricant from the engine 12, the position of the power generator unit 10 can be tipped in the direction of the rear access opening 44 allowing the position of the fitted fluid hole adapter 60 to descend from the fluid hole 21 towards the rear access opening 44. This position allows the lubricant to easily drain from the engine 12 through the fluid hole adapter 60 and out through the rear access opening 44. The fluid hole adapter 60 can be used to fill and/or drain other types of fluids for the engine 12 or prime mover (e.g., fuel or fuel components, coolant, etc.)

Integrally formed along an outer edge 76 of the fluid hole adapter 60 is a groove 78 that positions the fluid hole adapter 60 within a bottom tray opening edge 80. The edge 80 of the bottom tray opening 54 fits into the groove 78 to secure the fluid hole adapter 60 to the bottom tray 38 and to close the opening 54. Therefore, when the fluid hole adapter 60 is not used in assisting the filling and draining of the engine with lubricant, the fluid hole adapter 60 can be fitted into the bottom tray access opening 54.

When the fluid hole adapter 60 is positioned within the bottom tray access opening 54, the fluid hole adapter 60 becomes an integral part the bottom tray 38. The integral fit between the fluid hole adapter 60 and the bottom tray 38 helps insulate the operating noise of the power generator unit 10 from the outside environment and inhibits dirt from entering the power generator unit 10.

Providing a location and purpose for the fluid hole adapter 60 when not being used in assisting in filling and draining lubricant from the engine 12 prevents the fluid hole adapter 60 from becoming misplaced. The fluid hole adapter 60 can also be positioned or stored in any recess area or compartment, assuring that the fluid hole adapter 60 is always available when needed.

The engine 12 can incorporate a fluid hole used to fill the engine 12 with lubricant and a separate fluid hole used to drain the engine 12 of lubricant. Therefore, the insulation cover can incorporate more than one access opening used to fill and/or drain lubricant from the engine 12. The bottom tray opening 54 can be located in various areas of the insulating cover 26 depending specifically on the location of the fluid hole or holes and overall engine design.

A power generator unit utilizing an insulation cover that at least partially covers the engine 12 and generator 22 with or without openings is also possible. The benefits of the fluid hole adapter 60 regardless of fluid hole location can be appreciated with any engine design or insulation cover design.

Although the present invention has been described in terms of a certain preferred embodiments; other embodiments apparent to those of ordinary skill in the art also are within the scope of this invention. Thus, various changes and modifications may be made without departing from the spirit and scope of the invention. Moreover, not all of the features, aspects and advantages are necessarily required to practice the present invention. Accordingly, the scope of the present invention is intended to be defined only by the claims that follow.

What is claims is:

1. A power generator unit comprising an internal combustion engine, a generator driven by the internal combustion engine, the internal combustion engine having at least one fluid hole, a cover surrounding at least a portion of the internal combustion engine, the cover including an opening, and a lid removably attached to the cover to close the opening, the lid including a channel on one side of the lid whereby the lid can be used to assist in filling and draining fluid through the fluid hole of the engine.

2. The power generator unit of claim 1, wherein the cover completely surrounds the engine and the generator.

3. The power generator unit of claim 1, wherein the cover surrounds at least a portion of the generator.

4. The power generator unit of claim 1, wherein the opening opens into a compartment formed at least in part by the cover.

5. The power generator unit of claim 1, wherein the opening opens into a recess formed on the cover.

6. The power generator unit of claim 1, wherein the opening is located in the vicinity below the fluid hole.

7. The power generator unit of claim 1, wherein the opening is surrounded by a raised portion of the cover.

8. The power generator unit of claim 1, wherein at least a portion of the lid is made of a resilient material.

9. The power generator unit of claim 1, wherein the lid has a recess that cooperates with a portion of the cover that forms at least a part of the opening to attach removably the lid to the cover.

10. The power generator unit of claim 1, wherein the lid and the engine include cooperating structure so as to attach removably the lid to the engine at a location near the lubricant filler hole.

11. The power generator unit of claim 10, wherein the lid includes a hole that fits around the fluid hole to attach removably the lid to the engine.

12. A method of servicing an internal combustion engine lubrication system comprising the steps of removing a detachable lid from a position on an engine cover in which the lid is integral with the structure of the cover, positioning the detachable lid from the cover on the engine at a position near a fluid hole of the engine, using the lid to guide lubricant relative to the fluid hole on the engine, and repositioning and reattaching the detachable lid on the cover.

13. The method of claim 12 additionally comprising the step of removably attaching the detachable lid to the engine.

14. The method of claim 13, wherein removably attaching the detachable lid involves inserting a boss on the engine into a hole in the lid such that the hole in the lid surrounds the fluid hole.

15. The method of claim 12, wherein reattaching the lid to the cover involves positioning a lip of the cover into a groove on the detachable lid.

16. A power generator unit comprising an internal combustion engine, a generator driven by the internal combustion engine, the internal combustion engine having a fluid hole, a cover surrounding at least a portion of the internal combustion engine, and means for guiding lubricant relative to the fluid hole, said means being movable between a storage position, in which said means is integral with the cover, and a position in which said means is removably attached to the engine at a position relative to the fluid hole to assist in filling and draining lubricant through the fluid hole of the engine.

17. The power generator of claim 16, wherein said means includes a hole that surrounds the fluid hole when said means is attached to the engine.

18. The power generator of claim 16, wherein at least a portion of said means is formed of a resilient material.

19. The power generator unit of claim 16, wherein the cover completely surrounds the engine and generator.

20. The power generator unit of claim 16, wherein the cover includes an opening into which said means is fitted when in the storage position, and the opening is located in a vicinity below the fluid hole.

21. The power generator unit of claim 20, wherein the opening is surrounded by a raised portion of the cover.

22. The power generator unit of claim 16, wherein the cover includes an access opening though which the fluid hole can be accessed.

23. A power generating device comprising a prime mover and a cover at least partially surrounding the prime mover, the prime mover including a body defining a fluid hole, the cover including a removable section that cooperates with the prime mover body to releasably attach to the body at a location near the fluid hole.

24. The power generating device of claim 23, wherein the prime mover is an internal combustion engine and the fluid hole is a lubricant filler hole that communicates with a lubrication system of the engine.

25. The power generating device of claim 23 additionally comprising an electrical power generator driven by the prime mover.

26. The power generating device of claim 23, wherein the removable section of the cover defines a fluid channel that communicates with the fluid hole when the removable section is attached to the prime mover body.

27. The power generating device of claim 23, wherein the removable section of the cover extends below the fluid hole when the removable section is attached to the prime mover body.

* * * * *

UNITED STATES PATENT AND TRADEMARK OFFICE

CERTIFICATE OF CORRECTION

PATENT NO. : 6,851,397 B2
DATED : February 8, 2005
INVENTOR(S) : Satoru Akimoto et al.

It is certified that error appears in the above-identified patent and that said Letters Patent is hereby corrected as shown below:

Column 8,
Line 4, delete "though" and insert -- through --.

Signed and Sealed this

Fourteenth Day of March, 2006

JON W. DUDAS
*Director of the United States Patent and Trademark Office*